US009465337B2

(12) United States Patent
Watanabe et al.

(10) Patent No.: US 9,465,337 B2
(45) Date of Patent: Oct. 11, 2016

(54) IMAGE FORMING APPARATUS

(71) Applicant: CANON KABUSHIKI KAISHA, Tokyo (JP)

(72) Inventors: Naoto Watanabe, Abiko (JP); Hiroyuki Eda, Moriya (JP); Yuichi Yamamoto, Nagareyama (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/003,182

(22) Filed: Jan. 21, 2016

(65) Prior Publication Data

US 2016/0216654 A1 Jul. 28, 2016

(30) Foreign Application Priority Data

Jan. 22, 2015 (JP) ..... 2015-010364

(51) Int. Cl.
*G03G 15/20* (2006.01)

(52) U.S. Cl.
CPC ..... *G03G 15/205* (2013.01)

(58) Field of Classification Search
CPC ..... G03G 15/205; G03G 15/50
See application file for complete search history.

(56) References Cited

U.S. PATENT DOCUMENTS

| | | | | |
|---|---|---|---|---|
| 8,165,483 | B2 | 4/2012 | Shiori | |
| 2002/0044788 | A1* | 4/2002 | Kawano | G03G 15/2003 399/67 |
| 2003/0035659 | A1* | 2/2003 | Uchiyama | G03G 15/50 399/69 |

* cited by examiner

*Primary Examiner* — Sandra Brase
(74) *Attorney, Agent, or Firm* — Canon USA, Inc. IP Division

(57) ABSTRACT

An image forming apparatus, upon receipt of an image formation request, controls execution of a second preparatory operation that needs to be performed so that the image forming unit is capable of performing image formation and, independently of the image formation request, controls execution of a first preparatory operation for preparation for the image forming unit before the second preparatory operation. The first and second preparatory operations are accompanied by driving of a photosensitive body. Further, the image forming apparatus, when the image formation request is received by the reception unit before completion of the first preparatory operation, determines whether the second preparatory operation is to be performed after the first preparatory operation without stopping driving of the photosensitive body or after the first preparatory operation by stopping driving of the photosensitive body, in accordance with content of image formation performed in response to the image formation request.

12 Claims, 11 Drawing Sheets

IMAGE FORMING APPARATUS

BACKGROUND OF THE INVENTION

1. Field of the Invention

The present invention relates to an image forming apparatus performing a preparatory operation independently of an image formation request.

2. Description of the Related Art

In existing image forming apparatuses, a preparatory operation accompanied by driving of an image forming unit is performed at the timing of power source activation, recovery from power saving, recovery from jam, door opening/closing, or the like, so that the image forming apparatus enters a state in which an image forming operation can be performed. When this preparatory operation is finished, the image forming apparatus enters a standby state and, upon receipt of an image formation request, starts an image formation preparatory operation in accordance with requested image formation content.

U.S. Pat. No. 8,165,483 proposes control in which an image forming apparatus, while performing stoppage processing subsequent to completion of an image forming operation, upon receipt of the next image forming operation request, performs an image formation preparatory operation without stopping the operation of an image forming unit, thereby reducing a waiting time before the next image formation is started.

However, as in U.S. Pat. No. 8,165,483, in the case where an image formation request is input during a preparatory operation for making the image forming apparatus enter a state of being able to perform an image forming operation, when the image formation preparatory operation is performed so as to be continued from the advance preparatory operation similarly to U.S. Pat. No. 8,165,483, the following problem is encountered. For example, there may be a case in which a time required for the image formation preparatory operation in a fixing unit becomes longer than a time required for the image formation preparatory operation in the image forming unit. In this case, the image forming unit continues to be driven until the image formation preparatory operation in the fixing unit is completed, thereby influencing the life time of the image forming unit.

SUMMARY OF THE INVENTION

The present invention provides an image forming apparatus that solves the problems described above.

According to a first aspect of the present invention, an image forming apparatus includes: an image forming unit configured to form an image by forming a toner image on a photosensitive body and transferring the formed toner image to a sheet; a reception unit configured to receive an image formation request for forming an image; and a control unit configured to, upon receipt of the image formation request by the reception unit, control execution of a second preparatory operation that needs to be performed so that the image forming unit is capable of performing image formation and, independently of the image formation request, control execution of a first preparatory operation for performing preparation for the image forming unit before the second preparatory operation, the first preparatory operation and the second preparatory operation being accompanied by driving of the photosensitive body. The control unit, when the image formation request is received by the reception unit before completion of the first preparatory operation, determines whether the second preparatory operation is to be performed after the first preparatory operation without stopping the driving of the photosensitive body or the second preparatory operation is to be performed after the first preparatory operation by stopping the driving of the photosensitive body, in accordance with content of image formation performed in response to the image formation request.

Further features of the present invention will become apparent from the following description of exemplary embodiments with reference to the attached drawings.

DESCRIPTION OF THE EMBODIMENTS

Hereinafter, embodiments of the present invention will be described in detail using the drawings.

First Embodiment

Configuration of Image Forming Apparatus

Figure 1:
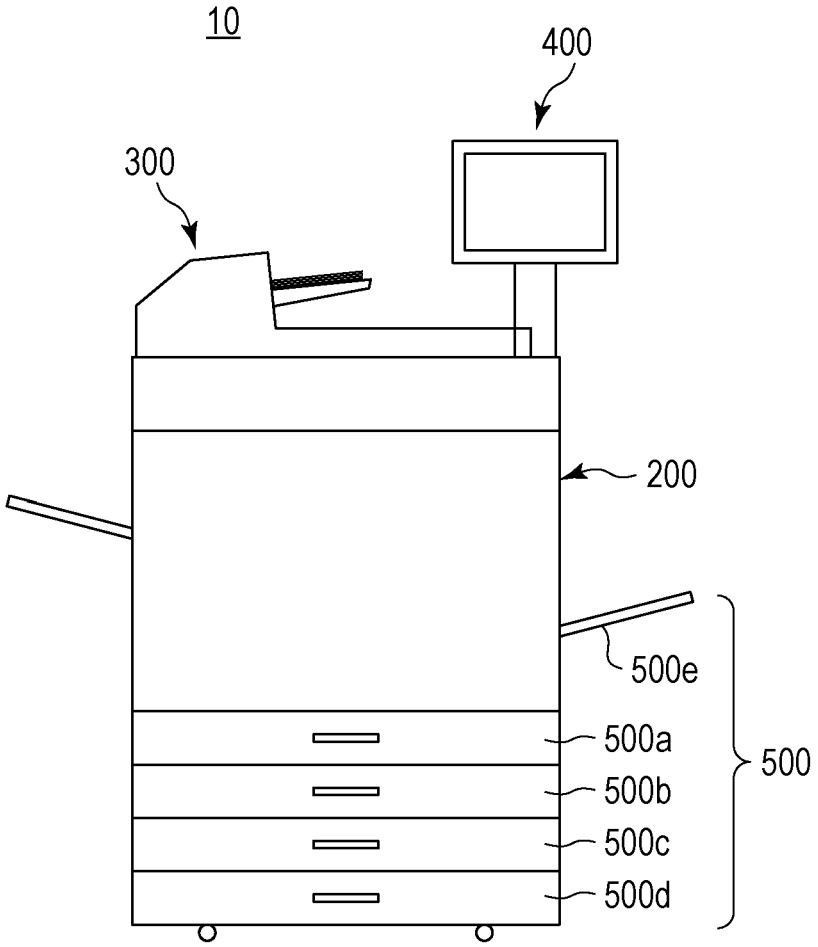
FIG. 1 is a diagram illustrating the whole configuration of an image forming apparatus.

FIG. 1 is a diagram illustrating the configuration of the whole image forming apparatus. An image forming apparatus 10 includes an image forming unit 200, a document reading unit 300, an operation unit 400, and a sheet storing unit 500. The sheet storing unit 500 includes cassettes 500*a* to 500*d* and a manual feeding portion 500*e*.

Image Forming Unit

Figure 2:
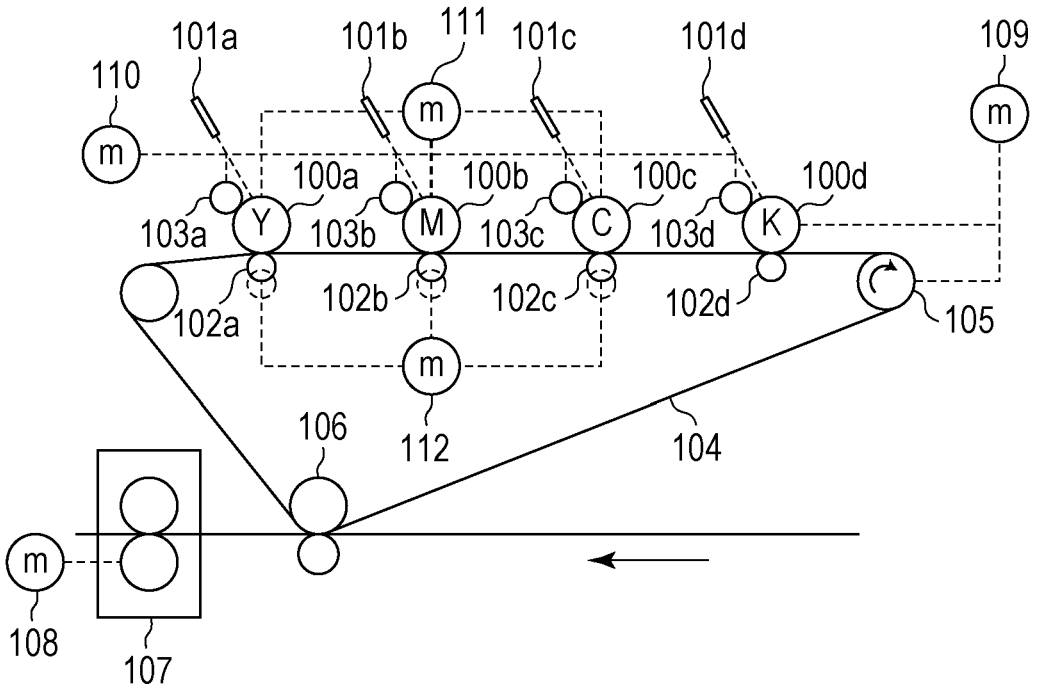
FIG. 2 is a diagram illustrating an image forming unit.

FIG. 2 is a diagram illustrating the details of the configuration of the image forming unit 200 of the image forming apparatus 10. The image forming apparatus 10 is a color image forming apparatus having image forming functions for four colors, i.e., yellow, (hereinafter abbreviated Y), magenta (hereinafter abbreviated M), and cyan (hereinafter abbreviated C), and black (hereinafter abbreviated K).

Photosensitive drums 100 (100*a* to 100*d*) are photosensitive drums on which electrostatic latent images for Y, M, C, and K are respectively formed (a, b, c, and d respectively correspond to Y, M, C, and K).

A monochrome drum motor 109 drives the photosensitive drum 100*d* and a belt driving roller 105. A color drum motor 111 drives the photosensitive drums 100*a* to 100*c*.

A developing motor 110 drives developing units 103 (103*a* to 103*d*), and the respective developing units are individually subjected to ON/OFF driving control through clutches (not illustrated) provided for the respective developing units.

Laser scanners 101*a* to 101*d* expose the surfaces of the respective photosensitive drums 100 in accordance with image signals, and form electrostatic latent images. The electrostatic latent images formed on the respective photosensitive drums 100 are developed by the developing units 103 using toner, whereby toner images are formed.

An intermediate transfer belt 104 rotates as a result of the belt driving roller 105 rotating. The toner images formed on the respective photosensitive drums 100 are sequentially transferred to the intermediate transfer belt 104 due to the operations of primary transfer rollers 102 (102*a* to 102*d*).

A separating motor 112 is a motor for moving the primary transfer rollers 102*a* to 102*c* for color printing. At the time of forming a monochrome image, the primary transfer rollers 102*a* to 102*c* are moved to the positions represented by dotted lines in the figure by a separating motor 112, whereby a separated state is entered in which the photosensitive drums 100*a* to 100*c* are separated from the intermediate transfer belt 104. Hence, even when the intermediate transfer belt 104 rotates while the color drum motor 111 is stopped, the intermediate transfer belt 104 does not frictionally slide on the photosensitive drums 100*a* to 100*c* and the primary transfer rollers 102*a* to 102*c*. Hence, the lifetimes of the intermediate transfer belt 104, the photosensitive drums 100*a* to 100*c*, and the primary transfer rollers 102*a* to 102*c* are inhibited from being shortened.

A secondary transfer roller 106 makes toner images corresponding to electrostatic latent images formed on the intermediate transfer belt 104 be transferred to a sheet which has been conveyed thereto. A motor 108 drives fixing rollers of a fixing unit 107.

Operation Unit

Figure 3:
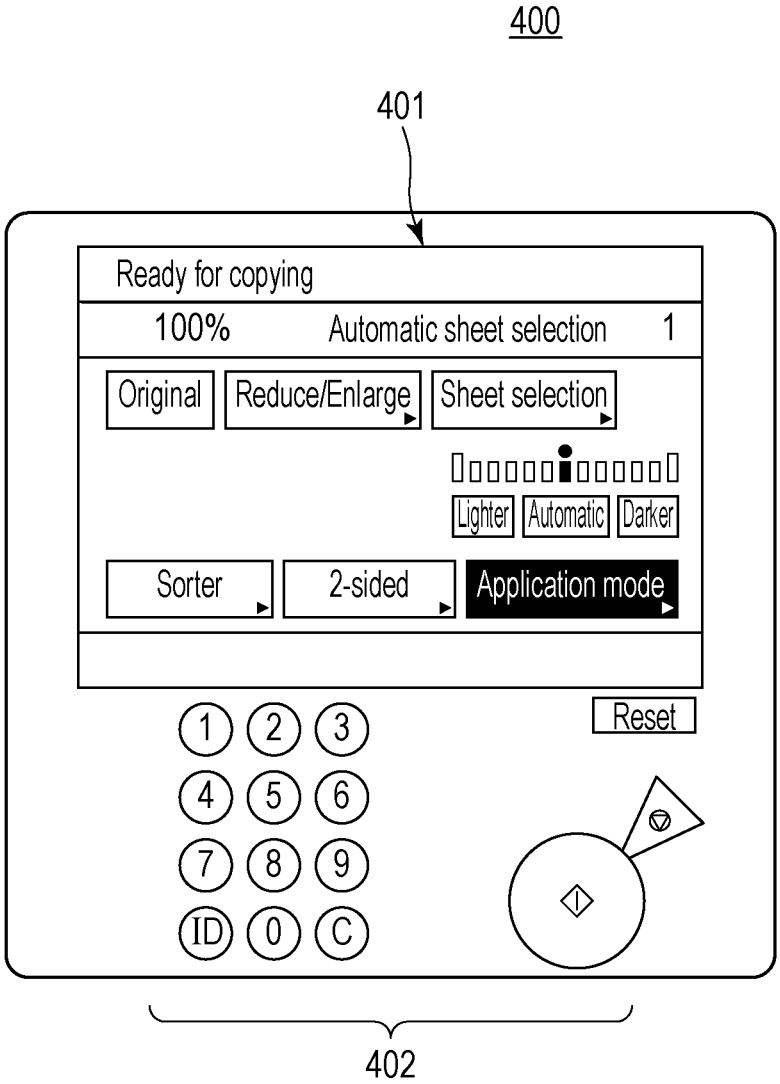
FIG. 3 is a diagram illustrating an operation unit.

The operation unit 400 in FIG. 3 is formed of a touch panel display screen 401 and button keys 402 such as numeric keys, a start-print key, and a stop-print key, allowing a user to perform various operations of the image forming apparatus 10.

Document Reading Unit

In the image forming apparatus 10, upon receipt of a print instruction from the operation unit 400, the document reading unit 300 reads the image of a document, and the read image is converted into image signals corresponding to color components, which are sent to respective laser scanners 101.

Then, the electrostatic latent images formed on the photosensitive drums 100 are developed by the developing units 103 using toners. The intermediate transfer belt 104 rotates clockwise in the figure, and the toner images formed on the photosensitive drums 100 are sequentially transferred to the intermediate transfer belt 104 through the primary transfer rollers 102.

Then, a sheet is transported from the sheet storing unit 500 in the direction of the arrow and at the location of the secondary transfer roller 106, the toner images corresponding to respective colors formed on the intermediate transfer belt 104 are transferred to the sheet in such a manner as to be superposed with one another. The toner images transferred to the sheet are fixed by the heat of the fixing unit 107, and the sheet with the toner images is ejected to the outside.

Block Diagram

Figure 4:
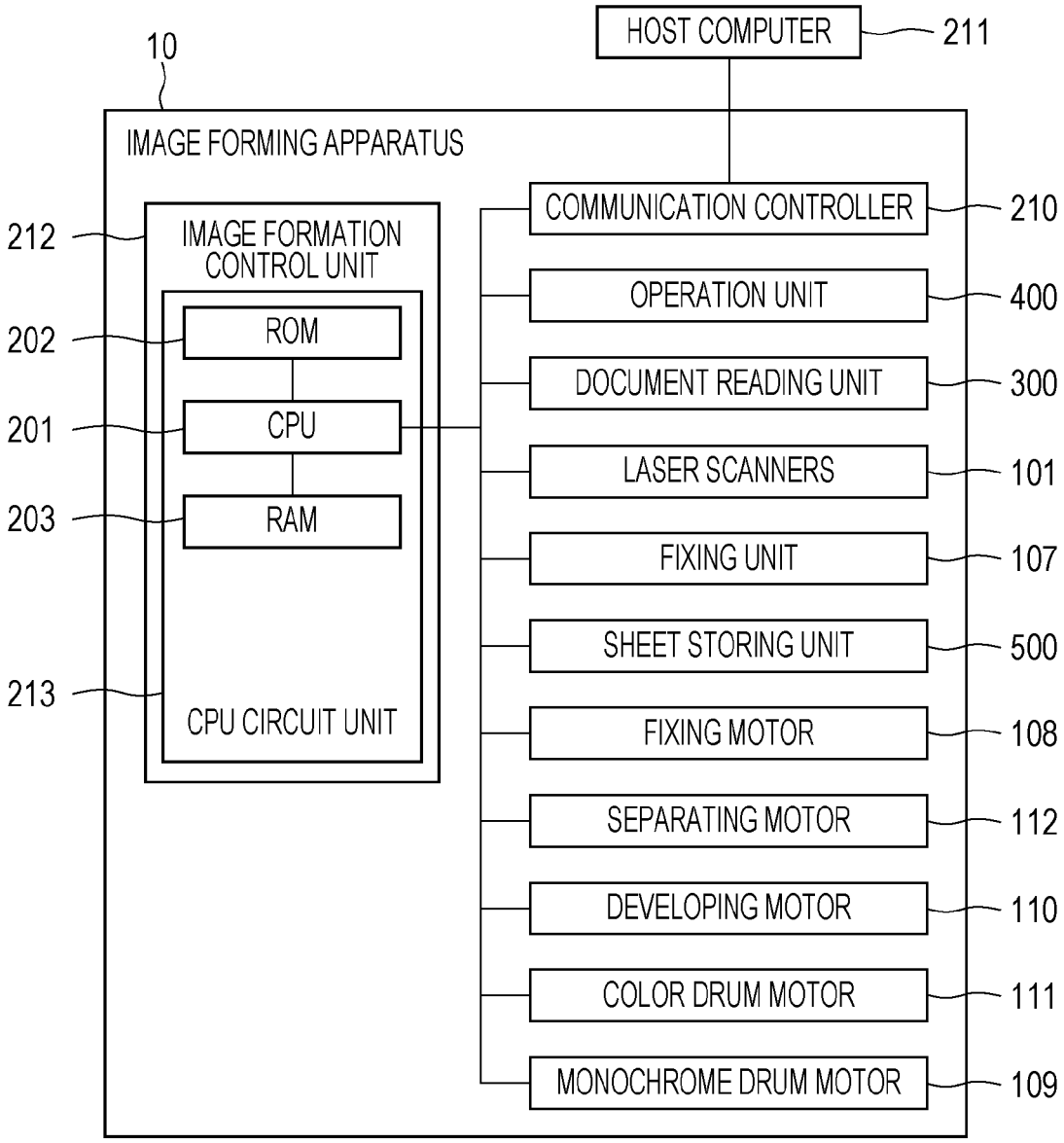
FIG. 4 is a block diagram illustrating the configuration of the image forming apparatus.

Next, the configuration of the image forming apparatus 10 will be described with reference to the block diagram illustrated in FIG. 4. An image formation control unit 212 of the image forming apparatus 10 performs control using a CPU circuit unit 213 formed of a CPU 201, a ROM 202, and a RAM 203.

The CPU circuit unit 213, upon receipt of an image formation request instruction from the operation unit 400 or from a host computer 211 through a communication controller 210, performs an image forming operation in accordance with a program stored in the ROM 202. In other words, the operation unit 400 and the communication controller 210 function as a reception unit that receives an image formation request.

Advance Preparatory Operation

Next, an advance preparatory operation for making the image forming apparatus 10 be ready for performing an image forming operation will be described. The advance preparatory operation is a preparatory operation of the image forming apparatus 10 executed in a stage prior to receiving an image formation request. The image forming apparatus 10, in preparation for the case in which a color image formation request is received, performs a preparatory operation in a color mode in which all the photosensitive drums 100 are driven so that color image forming operations can be immediately started.

For example, in an advance preparatory operation at the time of power-on of the image forming apparatus 10 or at the time of recovery from a power-saving mode, in the case where the internal state of the image forming apparatus 10 has changed because of a long period of no image forming activities, image density adjustment control, color misalignment adjustment control, and the like are performed. The image density adjustment operation is an advance operation performed before image formation to adjust the image density to a given value. The color misalignment adjustment operation is an advance operation performed before image formation to reduce color misalignment by adjusting the relative positions of colors at the time when four-color toner images are superposed with one another.

In an advance preparatory operation subsequent to jam release after a sheet jam occurred, cleaning control for removing toner remaining on the intermediate transfer belt 104 and the photosensitive drums 100 is performed.

Note that image density correction control, color misalignment correction control, and cleaning control are publicly known techniques and, hence, description thereof is omitted.

Image Formation Preparatory Operation

Next, an existing general image formation preparatory operation performed upon receipt of an image formation request in a standby state in which the image forming apparatus 10 is waiting for an image formation request will be described.

Figure 5:
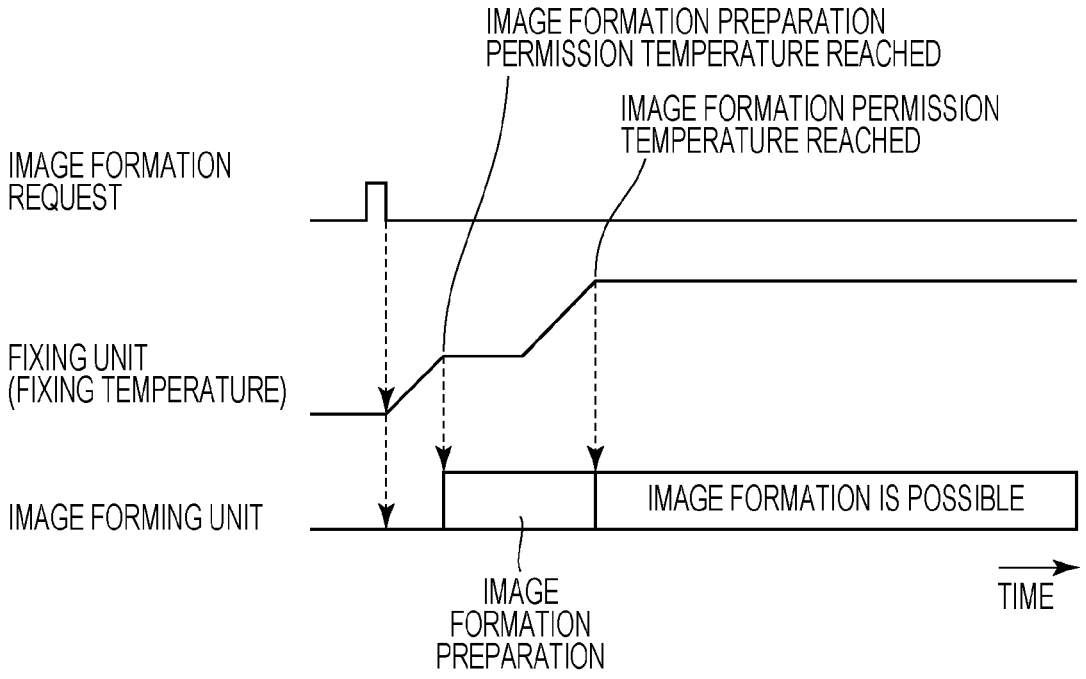
FIG. 5 is an explanatory diagram of an image formation preparatory operation.

FIG. 5 is a diagram illustrating the relationship between an image formation preparatory operation in the fixing unit 107 after reception of an image formation request and an image formation preparatory operation in the image forming unit 200.

The CPU 201, upon receipt of an image formation request, determines the content of respective image formation preparatory operations in the fixing unit 107 and the image forming unit 200 on the basis of job information attached to the request, for example, a color mode and a sheet type.

Upon receipt of an image formation request, temperature adjustment control for the fixing unit 107 is started as an image formation preparatory operation. However, the image formation preparatory operation in the image forming unit 200 is not immediately started. When the fusing temperature of the fixing unit 107 reaches an image formation preparation permission temperature, the CPU 201 starts driving the photosensitive drums 100, the developing units 103, and the like and starts a high-voltage start-up operation. When the fusing temperature of the fixing unit 107 reaches an image formation permission temperature and the image formation preparatory operation in the image forming unit 200 is completed, a state (standby state) in which an image forming operation is possible is entered.

The image formation preparation permission temperature described above is determined on the basis of a time required for the temperature of the fixing unit 107 to reach the image formation permission temperature, a time required for the image formation preparatory operation of the image forming unit 200 to be finished, and the characteristics of a change in temperature of the fixing unit 107. In this manner, by controlling the start timing of the image formation preparatory operation of the image forming unit 200, an unnecessary drive time in the image forming unit 200 is eliminated and influence on the lifetime is suppressed.

Preparation Continuation Control

Figure 6A:
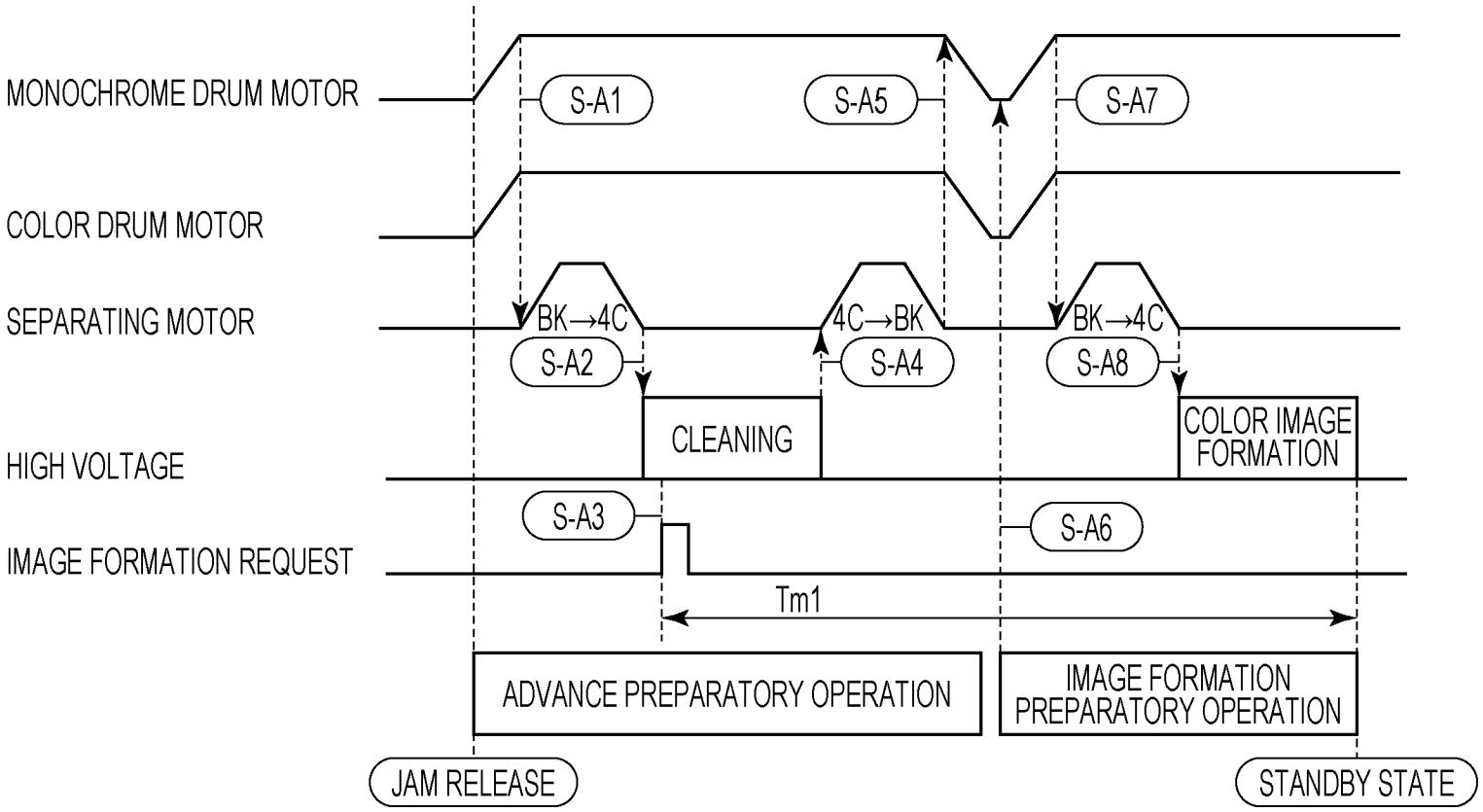
FIGS. 6A and 6B are explanatory diagrams of preparation continuation control.
Figure 6B:
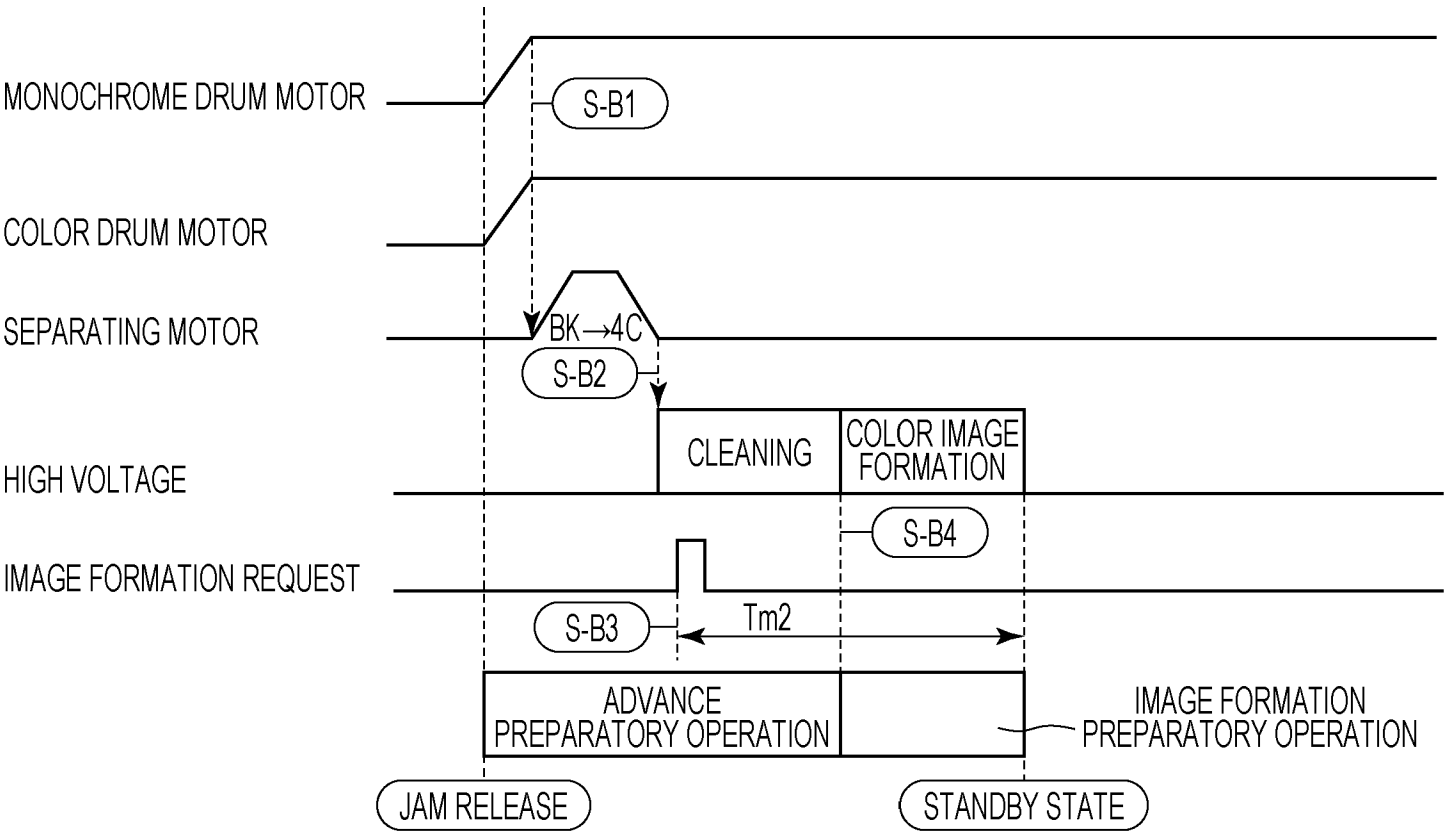

Next, preparation continuation control will be described. FIGS. 6A and 6B are diagrams illustrating the behavior of the image forming unit 200 before entering a standby state in the case where an image formation request in a color image forming mode is generated during an advance preparatory operation in a recovery operation after jam release.

FIG. 6A illustrates an operation in the case where preparation continuation control is not performed. After jam release, the monochrome drum motor 109 and the color drum motor 111 are started to be driven, as an advance preparatory operation.

When the speeds of the monochrome drum motor 109 and the color drum motor 111 reach constant speeds, by driving the separating motor 112, an operation for moving the primary transfer rollers 102*a* to 102*c* for color printing to respective positions in contact with the photosensitive drums 100*a* to 100*c* is started (S-A1).

When the primary transfer rollers 102*a* to 102*c* have come to be in contact with the photosensitive drums 100*a* to 100*c*, high-voltage output necessary for cleaning processing is started, whereby a cleaning operation is performed (S-A2).

When an image formation request is generated during the cleaning operation (S-A3), an image formation preparatory operation is not immediately started. When the cleaning operation is finished, an operation of separating the primary transfer rollers 102*a* to 102*c* from the photosensitive drums 100*a* to 100*c* is started (S-A4) as a result of the separating motor 112 being driven. When the separation operation is completed, an operation of stopping driving of the monochrome drum motor 109 and the color drum motor 111 is started, and the advance preparatory operation ends as a result of an operation of stopping driving of the motors being completed (S-A5).

When the advance preparatory operation is finished, an image formation preparatory operation is started. As the image formation preparatory operation, the start-up process of the monochrome drum motor 109 and the color drum motor 111 is performed (S-A6).

When the startup process of the monochrome drum motor 109 and the color drum motor 111 is completed, an operation for making the primary transfer rollers 102*a* to 102*c* for color printing be in contact with the photosensitive drums 100*a* to 100*c* is started as a result of the separating motor 112 being driven (S-A7).

When the primary transfer rollers 102*a* to 102*c* have come to be in contact with the photosensitive drums 100*a* to 100*c*, high-voltage output necessary for forming color images is started (S-A8).

Upon completion of the high-voltage output, the image formation preparatory operation is finished and a standby state in which image formation is possible is entered. The time from generation of the image formation request to completion of the image formation preparatory operation is Tm1.

FIG. 6B illustrates an operation in the case where preparation continuation control is performed. After jam release, the monochrome drum motor 109 and the color drum motor 111 are started to be driven, as an advance preparatory operation.

When the speeds of the monochrome drum motor 109 and the color drum motor 111 reach constant speeds, by driving the separating motor 112, an operation for moving the primary transfer rollers 102*a* to 102*c* for color printing to positions in contact with the photosensitive drums 100*a* to 100*c* is started (S-B1).

When the primary transfer rollers 102*a* to 102*c* have come to be in contact with the photosensitive drums 100*a* to 100*c*, high-voltage output necessary for cleaning processing is started, whereby a cleaning operation is started (S-B2). When an image formation request notification is received during the cleaning operation (S-B3), the received image formation request notification is stored in the RAM 203. The advance preparatory operation ends upon completion of the cleaning operation, and then, high-voltage output is performed in succession as an image formation preparatory operation required for color image formation (S-B4). Upon completion of the high-voltage output, the image formation preparatory operation is completed, and a standby state in which image formation is possible is entered. The time from generation of the image formation request to completion of the image formation preparatory operation is Tm2.

It is specified that after jam release, image formation which has not been completed due to generation of the jam is performed as recovery processing. Hence, in FIG. 6B, since the primary transfer rollers 102*a* to 102*c* and the color drum motor 111 are already in a state of being ready to form a color image even when the processing to be performed in S-A4 to S-A8 in FIG. 6A is not performed, the image formation preparatory operation can be performed in continuation with the advance preparatory operation. As a result, the time Tm2 from generation of the image formation request to completion of the image formation preparatory operation is shorter than the time Tm1 in FIG. 6A. Hence, the time required before the start of image formation can be reduced.

Determination Control

Next, determination control of determining whether or not the preparation continuation control can be performed will be described with reference to the drawings.

Figure 7A:
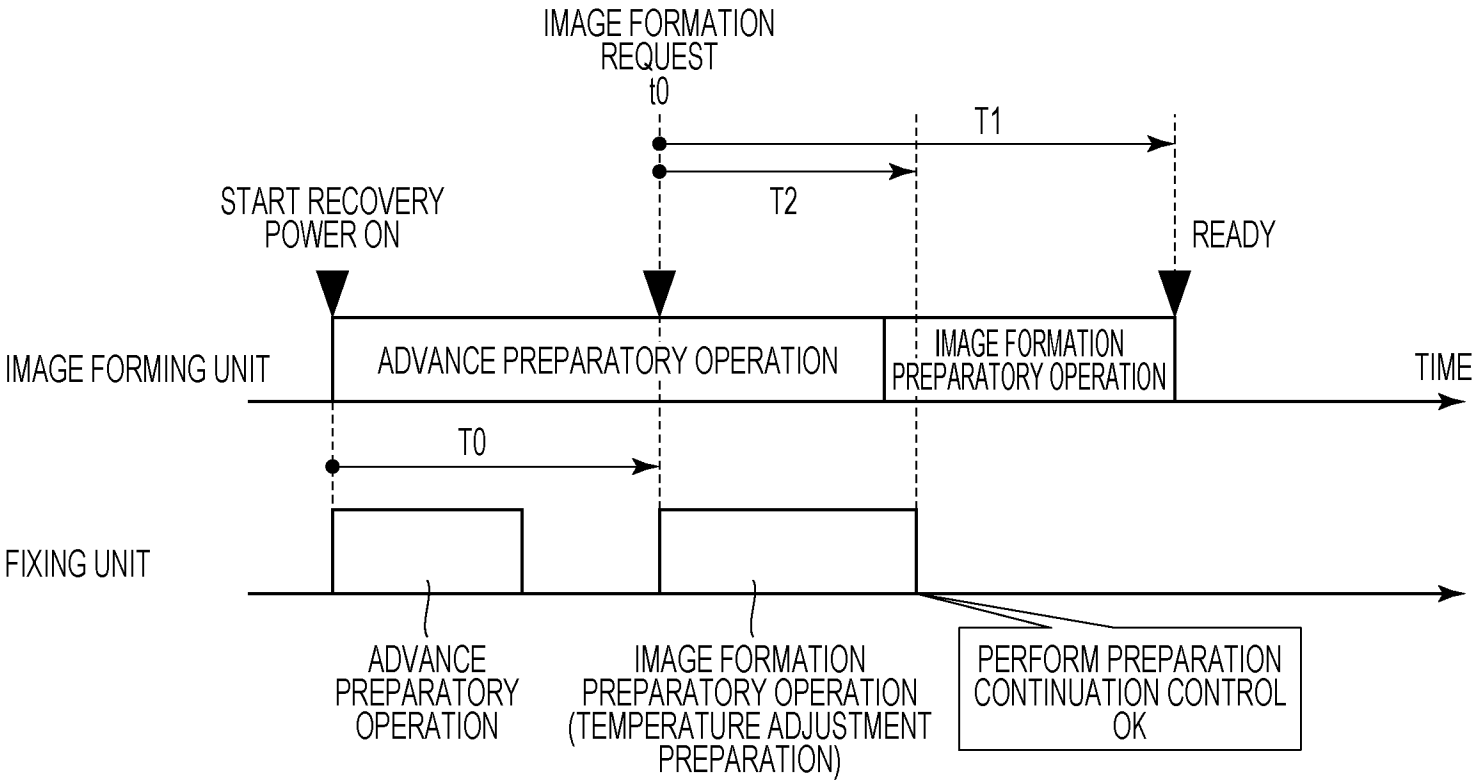
FIGS. 7A and 7B are explanatory diagrams illustrating whether or not the preparation continuation control can be performed.

FIG. 7A is a diagram illustrating the relationship between the advance preparatory operation and the image formation preparatory operation of each of the image forming unit 200 and the fixing unit 107 in the case where the preparation continuation control can be performed. Through recovery processing performed after power source activation or jam release, an advance preparatory operation is started independently of an image formation request. As an advance preparatory operation in the fixing unit 107, initial position checking for the separating mechanism of the fixing roller is performed. As an advance preparatory operation in the image forming unit 200, the cleaning control and image density control described above are performed. For this purpose, the monochrome drum motor 109 and the color drum motor 111 are driven, for example. Upon receipt of a notification of an image formation request at timing t0 during the advance preparatory operation, the content of the image formation preparatory operation to be performed is determined on the basis of color mode information, sheet type information, and the like, attached to the image formation request.

A time T2 from receipt of an image formation request to completion of the image formation preparatory operation in the fixing unit 107 and a time T1 from receipt of the image formation request to completion of the image formation preparatory operation in the image forming unit 200 described above are calculated.

In the case of FIG. 7A, the relationship T1≥T2 is satisfied and, hence, a state in which the photosensitive drums 100 idly rotates is not generated until the image formation preparatory operation in the fixing unit 107 is completed. As a result, preparation continuation control is performed in which the image formation preparatory operation is performed in continuation with the advance preparatory operation without stopping driving of the image forming unit 200.

Cases in which the preparation continuation control is performed include a case in which the image formation preparatory operation immediately ends in a state in which the temperature of the fixing unit 107 is already close to the image formation preparation permission temperature or a case in which time consuming processing such as image density control is performed as an advance preparatory operation in the image forming unit 200.

Figure 7B:
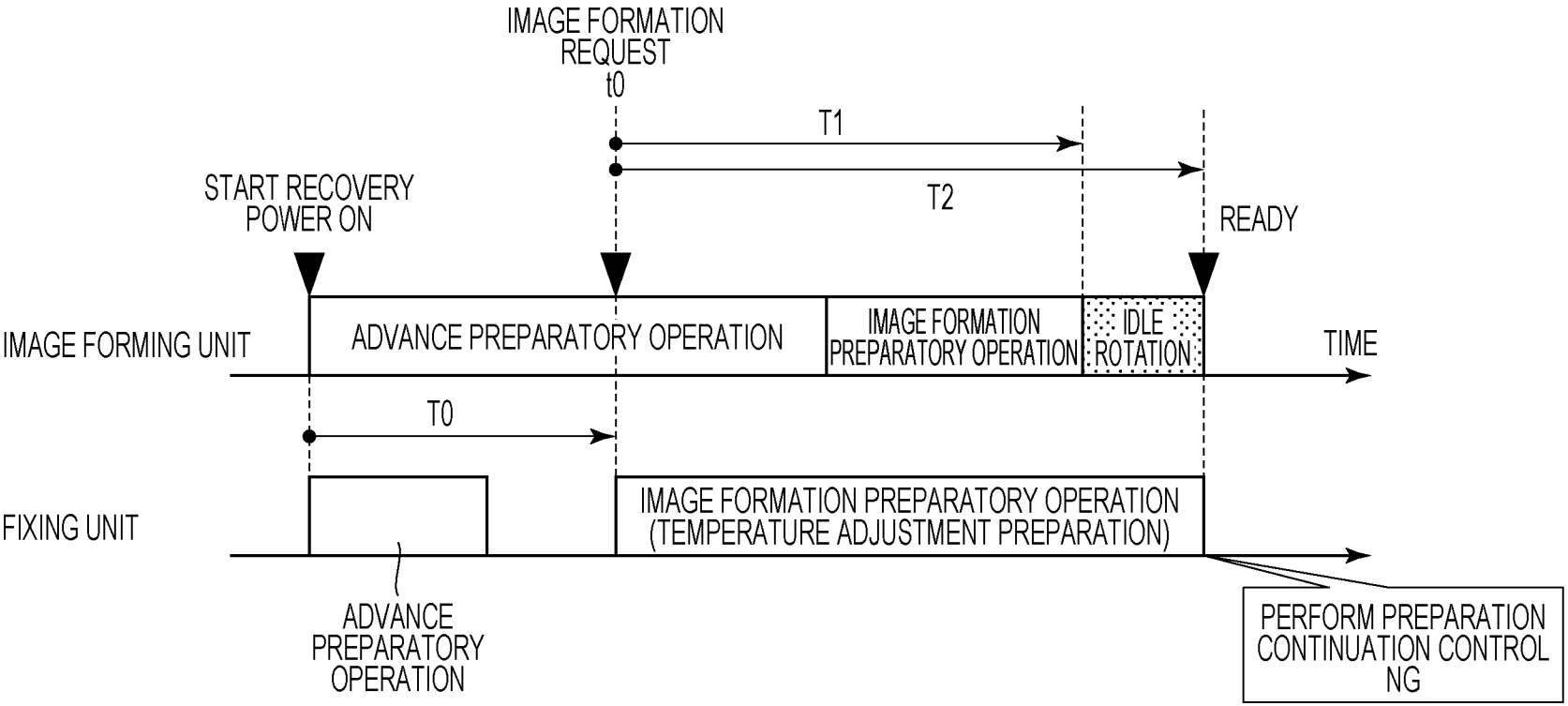

FIG. 7B is a diagram illustrating the relationship between the advance preparatory operation and the image formation preparatory operation of each of the image forming unit 200 and the fixing unit 107, in the case where the preparation continuation control cannot be performed. Similarly to the case of FIG. 7A, a time T2 from receipt of an image formation request to completion of the image formation preparatory operation in the fixing unit 107 and a time T1 from receipt of the image formation request to completion of the image formation preparatory operation in the image forming unit 200 are calculated.

In FIG. 7B, the relationship T1<T2 is satisfied and, hence, a state is generated in which the photosensitive drums 100 idly rotates until the image formation preparatory operation in the fixing unit 107 is completed. Hence, the driving of the image forming unit 200 is stopped in consideration of the lifetime of the components of the image forming unit 200. In other words, the image formation preparatory operation without performing the preparation continuation control described in FIG. 6A is performed.

Cases in which the preparation continuation control is not performed include a case in which the temperature of the fixing unit 107 is sufficiently lower than the image formation preparation permission temperature and it takes time to perform the image formation preparatory operation, or a case in which the advance preparatory operation or the image formation preparatory operation in the image forming unit 200 is finished in a comparatively short time.

The time T1 is calculated by subtracting a time T0 elapsed from the start of an advance preparatory operation to reception of an image formation request from the sum of a time required for the advance preparatory operation and a time required for the image formation preparatory operation.

Figure 8:
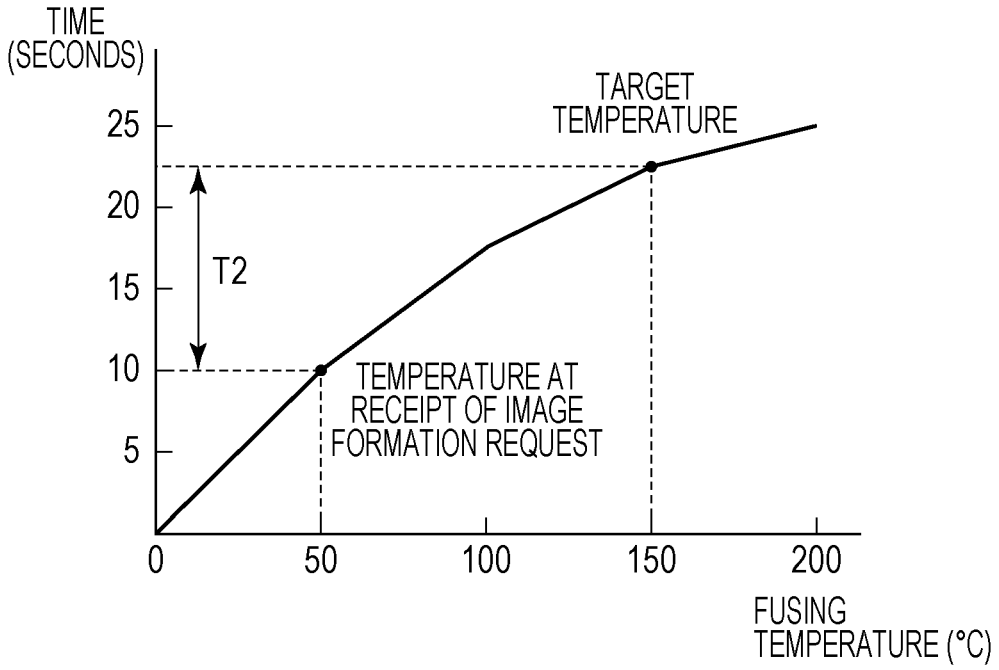
FIG. 8 is a diagram illustrating the relationship between a fusing temperature and a start-up time.

The time T2 is calculated on the basis of data about the relationship between a fusing temperature and a start-up time illustrated in FIG. 8 and on the basis of the fusing temperature at the time when the image formation request is received and a target temperature. Note that the target temperature is determined on the basis of information (for example, color mode information and sheet information) about the content of image formation attached to the image formation request. The data about the relationship between the fusing temperature and the start-up time is stored in the ROM 202.

In the example of FIG. 8, the temperature of the fixing unit 107 at the time when an image formation request is received is 50° C. and the target temperature is 150° C. and, hence, the time T2 is 22.5-10=12.5 seconds. Note that in FIG. 7B and FIG. 8, the case is shown in which notification of an image formation request is received after the advance preparatory operation in the fixing unit 107 has been completed and, hence, the time T2 is calculated only from the image formation preparatory operation time. When the image formation request is received during the advance preparatory operation in the fixing unit 107, the time T2 is calculated by subtracting the time T0 from the sum of a time required for the advance preparatory operation and a time required for the image formation preparatory operation.

Preparation Continuation Control Selection

Figure 9:
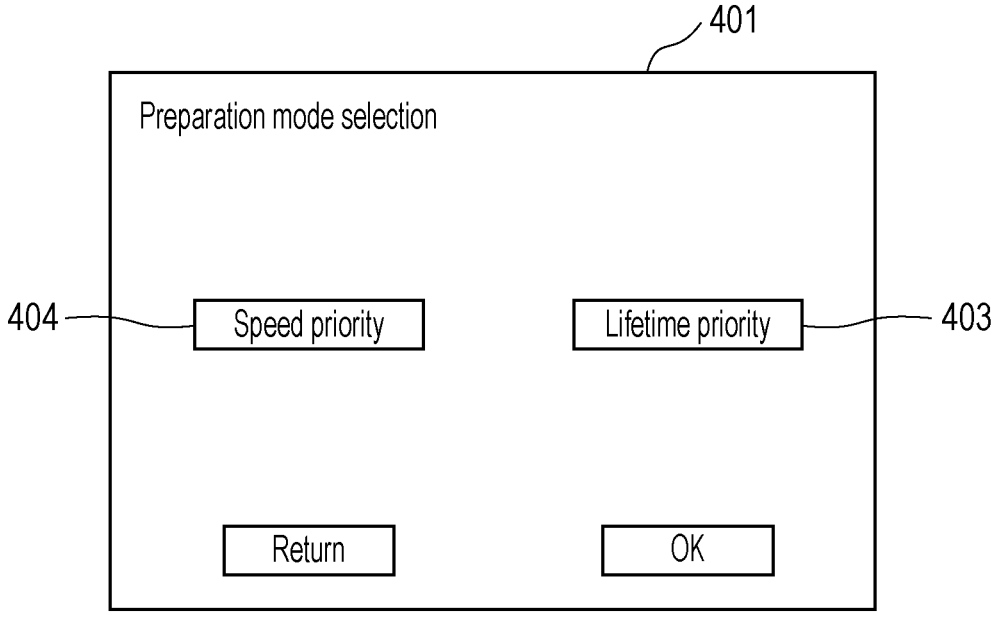
FIG. 9 is a diagram illustrating a preparation continuation control selection screen.

In the above-described determination control regarding whether or not the continuation control can be performed, valid/invalid options can be selected through a setting screen displayed in the display screen 401 of the operation unit 400 illustrated in FIG. 9. A speed-priority button 404 is selected by a user when reduction, as much as possible, in the time from the image formation request to the start of image formation is a priority rather than prioritizing the lifetimes of photosensitive bodies and the like. When a lifetime-priority button 403 is selected, the determination control described above becomes valid, whereby a state in which the image forming unit 200 idly rotates can be suppressed. When the speed-priority button 404 is selected, the determination control described above becomes invalid, and the continuation control is always performed independently of the content of image formation and, hence, when starting of image formation is instructed during advance preparation, a time required before the start of image formation can be reduced.

Flowchart

Figure 10:
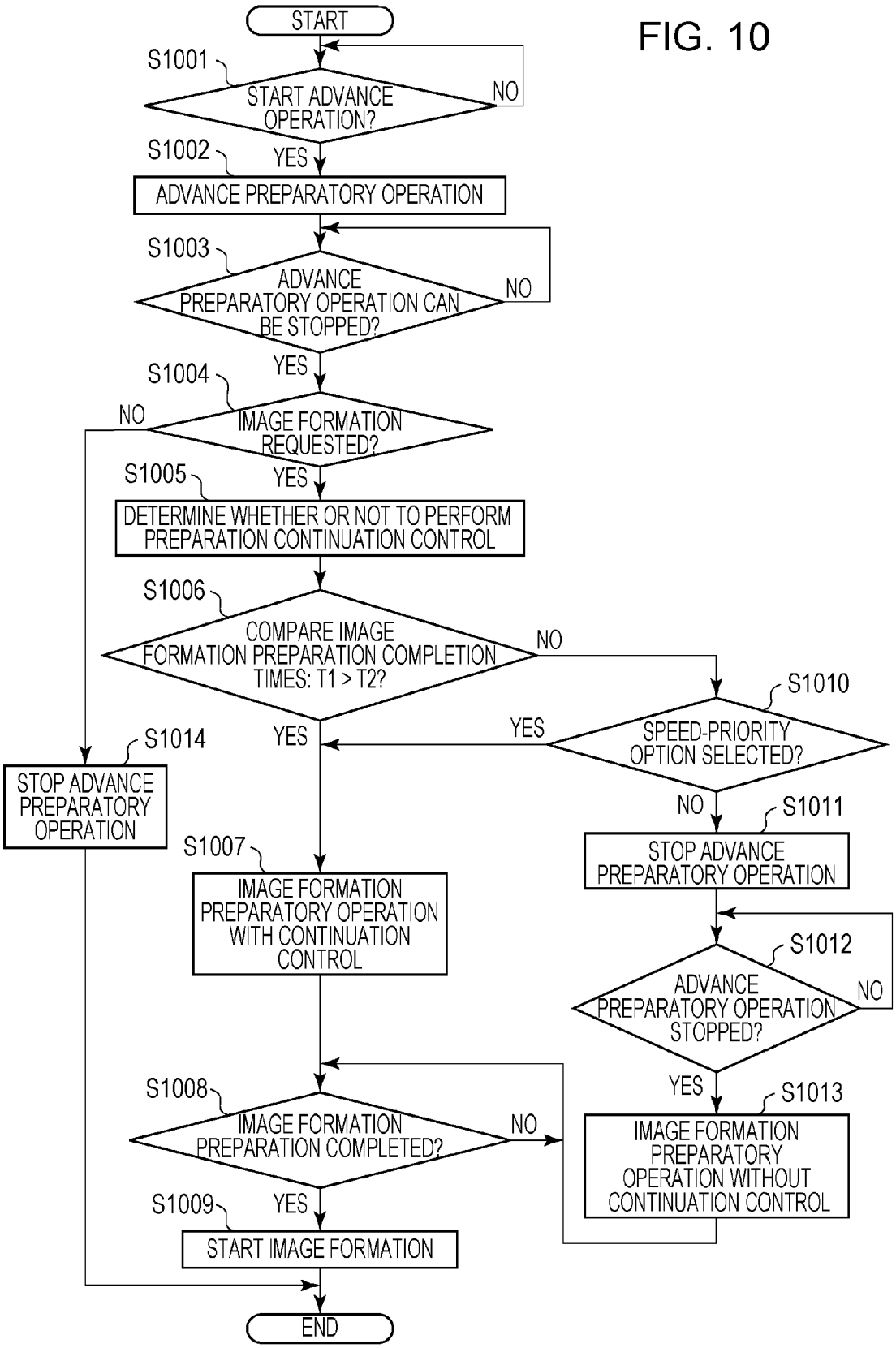
FIG. 10 is a flowchart illustrating a control operation.

FIG. 10 is a flowchart of preparation continuation control performed by the CPU 201.

In step S1001, the CPU 20 is powered on and it is determined whether or not an advance preparatory operation such as recovery processing after jam release is necessary. When it is determined that an advance preparation is necessary, the flow proceeds to step S1002.

In step S1002, an advance preparatory operation in the image forming unit 200 is started.

In step S1003, it is determined whether or not a state is entered in which the load of the image forming unit 200 can be terminated as a result of processing necessary in the advance preparatory operation in the image forming unit 200 has been completed, and when it is determined that the load can be terminated, the flow proceeds to step S1004.

In step S1004, it is determined whether or not an image formation request has been generated before the completion of the advance preparatory operation. When it is determined that an image formation request has been generated, the flow proceeds to step S1005. When it is determined that a request has not been generated, the flow proceeds to step S1014, where the advance preparatory operation is stopped.

In step S1005, determination processing regarding the execution of preparation continuation control is started, and then the flow proceeds to step S1006.

In step S1006, as in the determination control described above, on the basis of information attached to the image formation request, the time T1 required for the image formation preparatory operation in the image forming unit 200 and the time T2 required for the image formation preparatory operation in the fixing unit 107 are determined and compared with each other. When the relation T1>T2 is satisfied, there is no influence on the lifetime of the image forming unit 200 and, hence, it is determined that the preparation continuation control can be performed and the flow proceeds to step S1007. When the relation is not satisfied, it is determined that there is an influence on the lifetime, and the flow proceeds to step S1010.

In step S1007, the image formation preparatory operation with the preparation continuation control illustrated in FIG. 6B is started and then the flow proceeds to step S1008.

In step S1008, it is determined whether or not all the image formation preparatory operations including those of the image forming unit 200 and the fixing unit 107 have been completed, and the flow proceeds to step S1009 when the preparation has been completed.

In step S1009, the image forming unit 200 starts image formation on the basis of information attached to the received image formation request.

In step S1010, on the basis of the above-described determination regarding the setting for preparation continuation control options, the flow proceeds to step S1007 when the speed-priority option has been selected, and the image formation preparatory operation with the preparation continuation control is performed. In other words, the image formation preparatory operation with the preparation continuation control is performed irrespective of the content of image formation.

On the other hand, when the lifetime-priority option has been selected in step S1010, the flow proceeds to step S1011, where processing for terminating the advance preparatory operation is started by prioritizing increasing of the lifetime of the image forming unit 200, and the flow proceeds to step S1012.

In step S1012, termination of advance preparatory operations in all the units including the image forming unit 200 and the fixing unit 107 is waited for, and after the termination, the image formation preparatory operation without the preparation continuation control illustrated in FIG. 6A is started in step S1013. After this, the flow proceeds to step S1008.

As described above, according to the present embodiment, when the time T1>the time T2, or when the speed-priority option is selected, a time required before the start of image formation can be reduced.

Note that a configuration may be employed in which the determination regarding selection of the speed-priority option in step S1010 is performed prior to step S1006. In this case, processing for step S1011 is performed when the determination result is No in step S1006.

In the embodiments described above, descriptions have been made using the relationship between the advance preparation times in the image forming unit 200 and the fixing unit 107. However, not limited this, for example, it may be determined whether or not the preparation continuation control is performed by adding to the determination conditions an advance preparatory operation in a sheet post-processing apparatus connected to the image forming apparatus 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010364, filed Jan. 22, 2015, which is hereby incorporated by reference herein in its entirety.

What is claimed is:

1. An image forming apparatus comprising:

an image forming unit configured to form an image by forming a toner image on a photosensitive body and transferring the formed toner image to a sheet;

a reception unit configured to receive an image formation request for forming an image; and a control unit configured to, upon receipt of the image formation request by the reception unit, control execution of a second preparatory operation that needs to be performed so that the image forming unit is capable of performing image formation and, independently of the image formation request, control execution of a first preparatory operation for preparation for the image forming unit before the second preparatory operation, the first preparatory operation and the second preparatory operation being accompanied by driving of the photosensitive body, wherein the control unit, when the image formation request is received by the reception unit before completion of the first preparatory operation, determines whether the second preparatory operation is to be performed after the first preparatory operation without stopping the driving of the photosensitive body or the second preparatory operation is to be performed after the first preparatory operation by stopping the driving of the photosensitive body, in accordance with content of image formation performed in response to the image formation request.

2. The image forming apparatus according to claim 1, further comprising:

a fixing unit configured to fix a toner image formed on a sheet by the image forming unit, wherein the control unit controls the image forming unit and the fixing unit in such a manner that a preparatory operation of the fixing unit is performed upon receipt of the image formation request and that, when a time required for the second preparatory operation determined in accordance with the content of the image formation is longer than a time required for a preparatory operation of the fixing unit, the second preparatory operation is performed without stopping driving of the photosensitive body after the first preparatory operation.

3. The image forming apparatus according to claim 2, wherein the control unit controls the image forming unit and the fixing unit in such a manner that, upon receipt of the image formation request, the preparatory operation of the fixing unit is performed, and when the time required for the second preparatory operation determined in accordance with the content of the image formation is shorter than the time required for the preparatory operation of the fixing unit, the second preparatory operation is performed by stopping the driving of the photosensitive body after the first preparatory operation.

4. The image forming apparatus according to claim 2, further comprising:

a temperature detection unit configured to detect temperature of the fixing unit, wherein the control unit determines a time required for a preparatory operation of the fixing unit on a basis of a temperature detected by the temperature detection unit at a time when the preparatory operation of the fixing unit is started and a target temperature of the fixing unit determined in accordance with the content of the image formation.

5. The image forming apparatus according to claim 1, wherein the control unit controls the image forming unit in such a manner that the first preparatory operation is performed after a sheet jam is generated and the jam is released, or the first preparatory operation is performed when the image forming apparatus is powered on.

6. The image forming apparatus according to claim 1, further comprising:

a mode selection unit configured to allow advance manual selection of a mode invalidating execution of the second preparatory operation without stopping driving of the photosensitive body after the first preparatory operation.

7. The image forming apparatus according to claim 6, wherein, when the mode for invalidation is selected by the mode selection unit, the control unit, irrespective of the content of the image formation performed by the image formation request, controls the image forming unit in such a manner that the second preparatory operation is performed without stopping driving of the photosensitive body after the first preparatory operation.

8. The image forming apparatus according to claim 1, wherein the first preparatory operation includes cleaning the photosensitive body.

9. The image forming apparatus according to claim 1, wherein the first preparatory operation includes an image density adjusting operation for adjusting, in advance, a density of an image formed by the image forming unit.

10. The image forming apparatus according to claim 1, wherein the image forming unit includes a plurality of photosensitive bodies for forming toner images respectively corresponding to a plurality of color components, and an intermediate transfer body to which toner images formed on the plurality of photosensitive bodies are transferred, and wherein the first preparatory operation includes a color misalignment adjusting operation for reducing, in advance, possible color misalignment observed when the toner images formed on the plurality of photosensitive bodies are superposed with one another on the intermediate transfer body.

11. The image forming apparatus according to claim 1, further comprising:

a selection unit configured to select a mode for invalidating a control operation for determining whether the second preparatory operation is to be performed after the first preparatory operation without stopping the driving of the photosensitive body or the second preparatory operation is to be performed after the first preparatory operation by stopping the driving of the photosensitive body.

12. The image forming apparatus according to claim 11, wherein the mode is a mode in which reduction of a time from input of the image formation request to a start of image formation is more prioritized than a lifetime of the image forming unit.

* * * * *